US011584152B2

(12) United States Patent
Wang et al.

(10) Patent No.: US 11,584,152 B2
(45) Date of Patent: Feb. 21, 2023

(54) WRITING TOOL WITH ANTI-DRYING DEVICE

(71) Applicant: QINGDAO BEST POINT STATIONERY CO., LTD., Qingdao (CN)

(72) Inventors: Yuanhong Wang, Qingdao (CN); Myoung Hyok Eo, Qingdao (CN)

(73) Assignee: QINGDAO BEST POINT STATIONERY CO., LTD., Qingdao (CN)

( * ) Notice: Subject to any disclaimer, the term of this patent is extended or adjusted under 35 U.S.C. 154(b) by 219 days.

(21) Appl. No.: 17/257,511

(22) PCT Filed: Dec. 5, 2019

(86) PCT No.: PCT/CN2019/123274
§ 371 (c)(1),
(2) Date: Dec. 31, 2020

(87) PCT Pub. No.: WO2020/114451
PCT Pub. Date: Jun. 11, 2020

(65) Prior Publication Data

US 2021/0260911 A1 Aug. 26, 2021

(30) Foreign Application Priority Data

Dec. 6, 2018 (KR) ..... 10-2018-0156472

(51) Int. Cl.
*B43K 5/17* (2006.01)
*B43K 23/12* (2006.01)

(52) U.S. Cl.
CPC ..... *B43K 5/17* (2013.01); *B43K 23/128* (2013.01)

(58) Field of Classification Search
CPC ..... B43K 5/17; B43K 8/028; B43K 24/084
See application file for complete search history.

(56) References Cited

U.S. PATENT DOCUMENTS 6,866,436 B2 * 3/2005 Kanari ..... B43K 24/02 401/117
7,220,073 B2 * 5/2007 Yoon ..... B43K 23/12 401/107

(Continued)

FOREIGN PATENT DOCUMENTS

CN 102414029 4/2012
CN 108528096 9/2018

(Continued)

*Primary Examiner* — David P Angwin
*Assistant Examiner* — Bradley S Oliver
(74) *Attorney, Agent, or Firm* — Jiwen Chen; Joywin IP Law PLLC

(57) ABSTRACT

Provided is a writing tool with an anti-drying device, comprising a pen holder (110), a pen tip (1) arranged in the pen holder (110), an ink cartridge (130) and a pressing rod (150). The writing tool with the anti-drying device further comprises an anti-drying device (200), wherein the anti-drying device (200) comprises a switch sleeve (210), a lifting cap (220), a tapping spring (214), a rotatable sealing cap (230), a sealing pad (240) and a support spring (244). The switch sleeve (210) is inserted in the pen holder (110), an elastic part (211) is respectively arranged on each of the two sides of the upper end of the switch sleeve (210), the switch sleeve (210) is further provided with a lifting groove (212) extending to be distributed on the elastic part (211), a rotating groove (213) is arranged on the side of the lower end of the switch sleeve (210); the lifting cap (220) is inserted in the switch cover (210), a support protrusion (221) is respectively arranged on each of the two sides of the upper end of the lifting cap (220), and the rotatable sealing cap (230) is used for turning so as to open or close an access hole (241).

10 Claims, 13 Drawing Sheets

(56) References Cited

U.S. PATENT DOCUMENTS

| | | | | |
|---|---|---|---|---|
| 8,177,447 | B2 * | 5/2012 | Yoon | B43K 8/028 401/107 |
| 9,340,060 | B2 * | 5/2016 | Cheon | B43K 8/028 |
| 10,099,505 | B2 * | 10/2018 | Yoon | B43K 24/08 |
| 10,183,524 | B2 * | 1/2019 | Yoon | B43K 5/17 |
| 10,434,815 | B2 * | 10/2019 | Cheon | B43K 24/08 |
| 2011/0103875 | A1 * | 5/2011 | Huang | B43K 8/24 401/104 |
| 2018/0215193 | A1 | 8/2018 | Yoon | |
| 2022/0227163 | A1 * | 7/2022 | Kim | B43K 8/028 |

FOREIGN PATENT DOCUMENTS

| | | |
|---|---|---|
| CN | 108528097 | 9/2018 |
| JP | 2007320156 | 12/2007 |
| JP | 2008110527 | 5/2008 |
| JP | 2016037011 | 3/2016 |
| KR | 200356102 | 7/2004 |
| KR | 100556569 | 3/2006 |
| KR | 1020170036828 | 1/2017 |
| KR | 20170044280 | 4/2017 |
| KR | 101774425 | 9/2017 |

* cited by examiner

WRITING TOOL WITH ANTI-DRYING DEVICE

This is a U.S. national stage application of PCT Application No. PCT/CN2019/123274 under 35 U.S.C. 371, filed Dec. 5, 2019 in Chinese, claiming priority to Korean Patent Application No. 10-2018-0156472, filed Dec. 6, 2018, all of which are hereby incorporated by reference.

TECHNICAL FIELD

The present invention relates to a writing tool with an anti-dry device to prevent a pen tip from drying out, in particular, to prevent the drying out of water-based ink or volatile ink in a retractable press type fluorescent or marker pen, wherein the anti-dry device is rotatable and provided inside a lower portion of a penholder to close its internal space.

BACKGROUND

Retractable press type fluorescents or markers are a type of water-based or volatile ink pen which have a button on the top, by clicking downward it, a pen tip is retracted or extends outside.

In order to prevent the ink from drying out, Korean Patent No. 10-0556569 discloses a writing instrument with an anti-dry structure, where the anti-dry structure is rotatably provided at one side inside a bottom of a penholder to prevent a pen tip from exposing to air flowing therein.

However, in order to functionally open and close an opening where the pen tip extends out or is retracted, the rotatable part of the writing instrument closely attaches to an inner wall of the bottom end of the penholder, this arrangement causes that it is incapable of smoothly rotating due to friction force therebetween, and further leading to worn-out or broken-down of the rotatable part, which may worsen sealing effect and fail to prevent inks from drying out.

In order to prevent the ink from drying out, especially to block air from flowing into a pen-tip end of a pen-tip tube body connected to the pen tip within an ink cartridge, a rubber ring in contact with the pen-tip tube body is provided in the prior art. But the retractable ink cartridge and rubber ring may rub against each other and obstruct the pen tip.

SUMMARY OF THE INVENTION

The present invention mainly solves the above-mentioned problems of prior art, wherein a rotatable closing cap and a sealing pad which form the anti-drying device are closely in contact with each other, and the rotatable closing cap rotates to open or close as the pen tip extends out or is retracted. The purpose is to reduce the friction during the rotation of the rotatable closing cap and enable the opening and closing of the penholder to be gentle and smooth, and also to prevent the worsening of tightness caused by friction and wear.

Another of the present invention is that an ink cartridge could move downward along lifting grooves and exert pressure on elastic parts, the elastic parts expand or are compressed within a switch sleeve so as to prevent a situation that the elastic parts returns to its original position as expanding outward; the switch sleeve does not move upward and maintains in a locked state and the opening and closing operation of the pen tip is much more smoother.

In order to achieve the objective of the present invention, the present invention provides a writing tool with an anti-dry device comprising: a penholder, a pen tip provided inside the penholder, an ink cartridge and a pressing rod, wherein the pen tip is connected to a lower portion of the ink cartridge, the pressing rod is located on an upper portion of the ink cartridge and configured to drive the ink cartridge moving through the penholder, characterized in that:

an inner wall of a lower portion of the penholder is provided with limiting protrusions, a mounting groove and a spring mounting surface, wherein the limiting protrusions is located above the spring mounting surface and the mounting groove is located between the limiting protrusions and the spring mounting surface;

fastening lifting protrusions and an anti-off clamping surface are provided on an outer wall of the ink cartridge and the anti-off clamping surface is located above the anti-off clamping surface;

and the writing tool is provided with an anti-drying device including a switch sleeve, a lifting cap, a tapping spring, a rotatable sealing cap, a sealing pad and a supporting spring;

wherein the switch sleeve is inserted into the penholder, an upper portion of the switch sleeve is respectively provided with an elastic part on both sides, and the switch sleeve is provided with two lifting grooves which respectively extends along the elastic parts; an anti-press protrusion fitting with the anti-off clamping surface is provided inside an upper end of each elastic part and a locking protrusion mating with the limiting protrusion is provided outside the upper end of each elastic part, and a lower portion of the switch sleeve is formed a rotating groove on both sides;

the lifting cap is inserted into the switch sleeve, wherein an upper portion of the lifting cap is provided with a supporting protrusion on both sides and a lower portion of the lifting cap is provided with a rotating shaft on both sides, the fastening lifting protrusions and the supporting protrusions are located up and down and respectively inserted into the lifting grooves on corresponding sides and the supporting protrusions are inserted into the mounting groove;

the tapping spring is inserted into switch sleeve and located between the lifting cap and the ink cartridge;

the rotatable sealing cap includes a closing surface and a rotating support part provided on each side of the closing surface, the rotating support part is provided with a shaft hole and a rotating operation protrusion which is eccentrically located at one side of the shaft hole, and the rotating shaft is inserted into the corresponding shaft hole and the rotating operation protrusion is inserted into the rotating groove;

the sealing pad is provided with an access hole allowing the pen tip to extend out or be retracted, and is located below the switch sleeve, and the supporting spring is arranged between the sealing pad and the spring mounting surface, and the access hole is opened and closed by the rotation of the rotatable sealing cap.

Further, it comprises a pen clip; the pen clip is inserted into the upper portion of the penholder and the pressing rod is inserted into the pen clip and connected to the ink cartridge, the inner wall of the penholder is provided with a sealing ring attaching to an outer wall of the pen clip.

Further, an outer wall of the pressing rod is provided with a sealing rubber ring groove, and a sealing rubber ring is arranged in the sealing rubber ring groove and located between the pen clip and the pressing rod.

Further, a spring insertion groove is formed at a lower portion of the sealing pad where an upper end of the supporting spring is inserted into.

Further, a plurality of rotating protrusions are provided on the inner wall of the penholder distributed around the center line of the penholder; the outer wall of the ink cartridge is provided with guiding protrusions and a limiting step surface and the limiting step surface is located above the guiding protrusions;

The writing tool with an anti-dry device further includes a tapping sleeve, lifting tapping teeth spaced equidistant from each other around an axis of the tapping sleeve are provided inside the tapping sleeve, annular teeth are provided at a lower portion of the tapping sleeve; wherein the lifting tapping teeth are fitting with the guiding protrusions and the annular teeth are clamped on the rotating protrusions.

Further, when the pen tip is retracted into the penholder, the closing surface of the rotatable sealing cap abuts against the sealing pad and seals the access hole; when the pen tip extends out of the pen holder, the closing surface of the rotatable sealing cap rotates to one side of the sealing pad to open the access hole.

The advantages and positive effects of the present invention are: the writing tool disclosed by the prevent invention comprises the penholder, the pressing rod provided on the upper portion of the penholder, the ink cartridge inserted into the penholder and ascending and descending with the pressing rod, and an anti-drying device for preventing ink from drying out which includes a switch sleeve capable of being inserted into a hollow structure below the ink cartridge, a lifting cap capable of ascending or descending within the switch sleeve, a rotatable sealing cap coupled with the lower portion of the lifting cap capable of rotating along the axis, a sealing pad inserted inside the lower portion of the penholder and closing attaching to the rotatable sealing cap which allows the pen tip to extend out or be retracted, and a supporting spring which elastically supports the sealing pad.

When exerting pressure on the sealing pad, the rotatable sealing cap moves relative to the switch sleeve; in order to prevent the elastic parts on the upper portion of the switch sleeve from being deformed by the ink cartridge from the inside to expand outward, anti-press protrusions and locking protrusions are provided on the inside and outside of the elastic parts respectively.

The sealing pad is lifted and lowered at certain intervals inside the lower portion of the penholder, the rotation of the rotatable sealing cap could seal the access hole opened on the sealing pad so as to seal the lower portion of the penholder. Additionally, the rubber sealing ring is arranged inside the upper portion of the penholder, the upper portion of the ink cartridge and the rubber sealing ring are in contact with each other to seal the inside of the penholder and to prevent ink from drying out because of air circulation between the inner space the outer environment.

Moreover, the access hole is opened and closed by the rotation of the rotatable sealing cap, when the rotatable sealing cap being rotated, the sealing pad and the rotatable sealing cap are separated by the movement of the supporting spring and there is no friction therebetween, so the opening and closing operation could be more gentle and smooth and the damage on parts caused by friction could be avoided.

The pen tip moves along with the pressing rod. In order to enable the pen tip to descend with the ink cartridge and the switch sleeve fastened to the lower portion of the ink cartridge within the penholder, as the pen tip descending, the elastic parts on both sides of the switch sleeve are stretched out the ink cartridge passing through, the locking protrusions are clamped on the upper portion of the limiting protrusions and the sealing pad under pressure downward could not move upward by the elastic force of the supporting spring, so a separation state of the rotatable sealing cap and the sealing pad could be reliably maintained.

Furthermore, in those area where the ink cartridge and the penholder are not in contact, air are not allowed to flow in through the upper portion of the penholder, and the pen tip could be operated in or out gentler.

REFERENCE SIGNS

110: penholder, 111: sealing ring, 112: rotating protrusion, 113: mounting groove, 114: limiting protrusion, 115: spring mounting surface, 116: operating space, 120: pen clip, 130: ink cartridge, 131: limiting step surface, 132: guiding protrusion, 133: fastening lifting protrusion, 134: anti-off clamping surface, 135: core coupling tube, 136: shielding surface, 140: tapping sleeve, 141: lifting tapping tooth, 142: annular teeth, 150: pressing rod, 160: sealing rubber ring, 200: anti-drying device, 210: switch sleeve, 211: elastic part, 211*a*: anti-pressure protrusion, 211*b*: locking protrusion, 212: lifting groove, 213: rotating groove, 214: tapping spring, 220: lifting cap, 221: supporting protrusion, 222: rotating shaft, 230: rotatable sealing cap, 231: closing surface, 232: rotating support part, 233: shaft hole, 234: rotating operation protrusion, 240: sealing pad, 241: access hole, 242: contact ring, 243: spring insertion groove, 244: supporting spring.

DETAILED DESCRIPTION OF THE EMBODIMENTS

Figure 1:
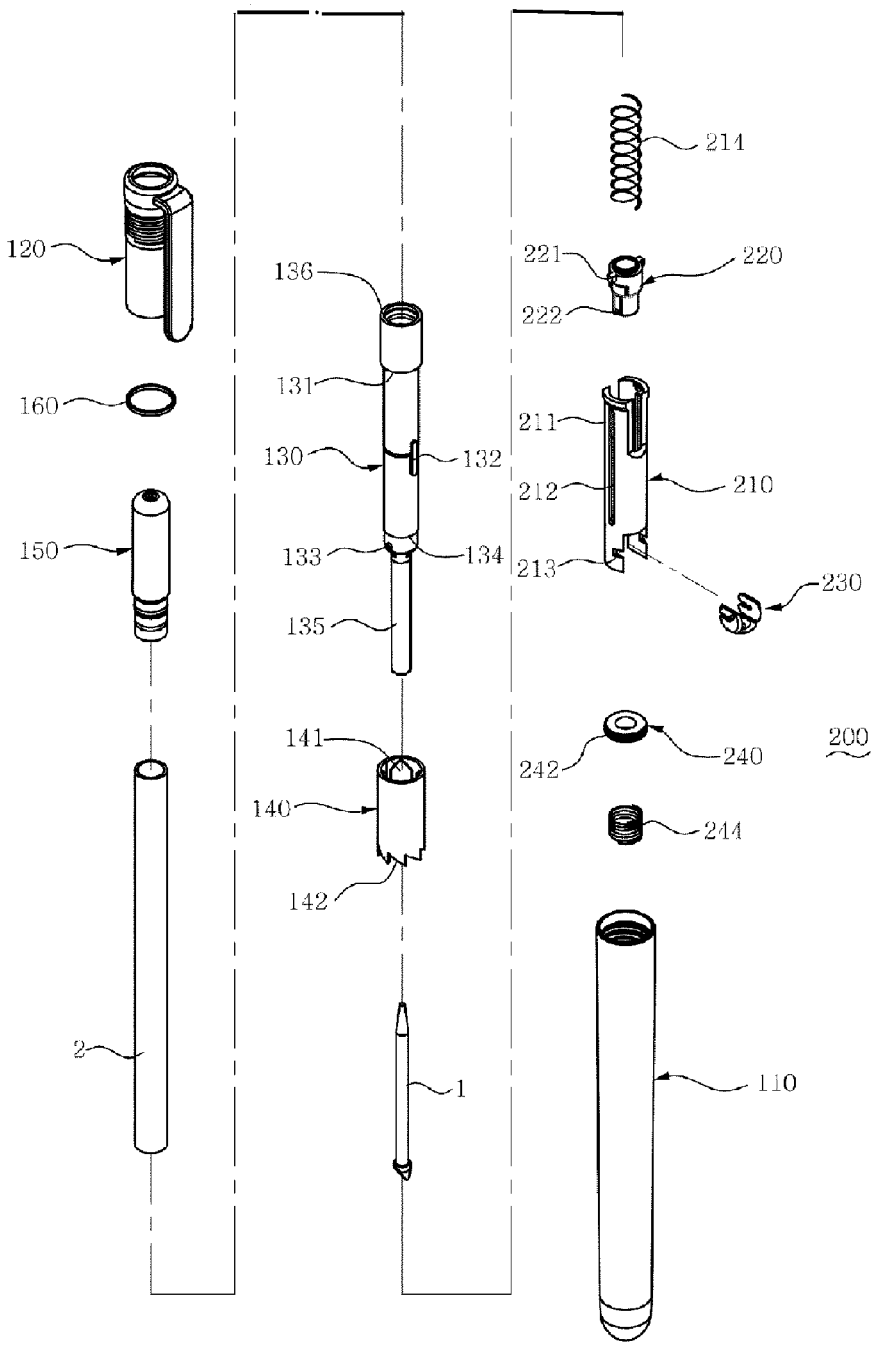
FIG. 1 is an exploded perspective view of an example of the present invention.
Figure 2:
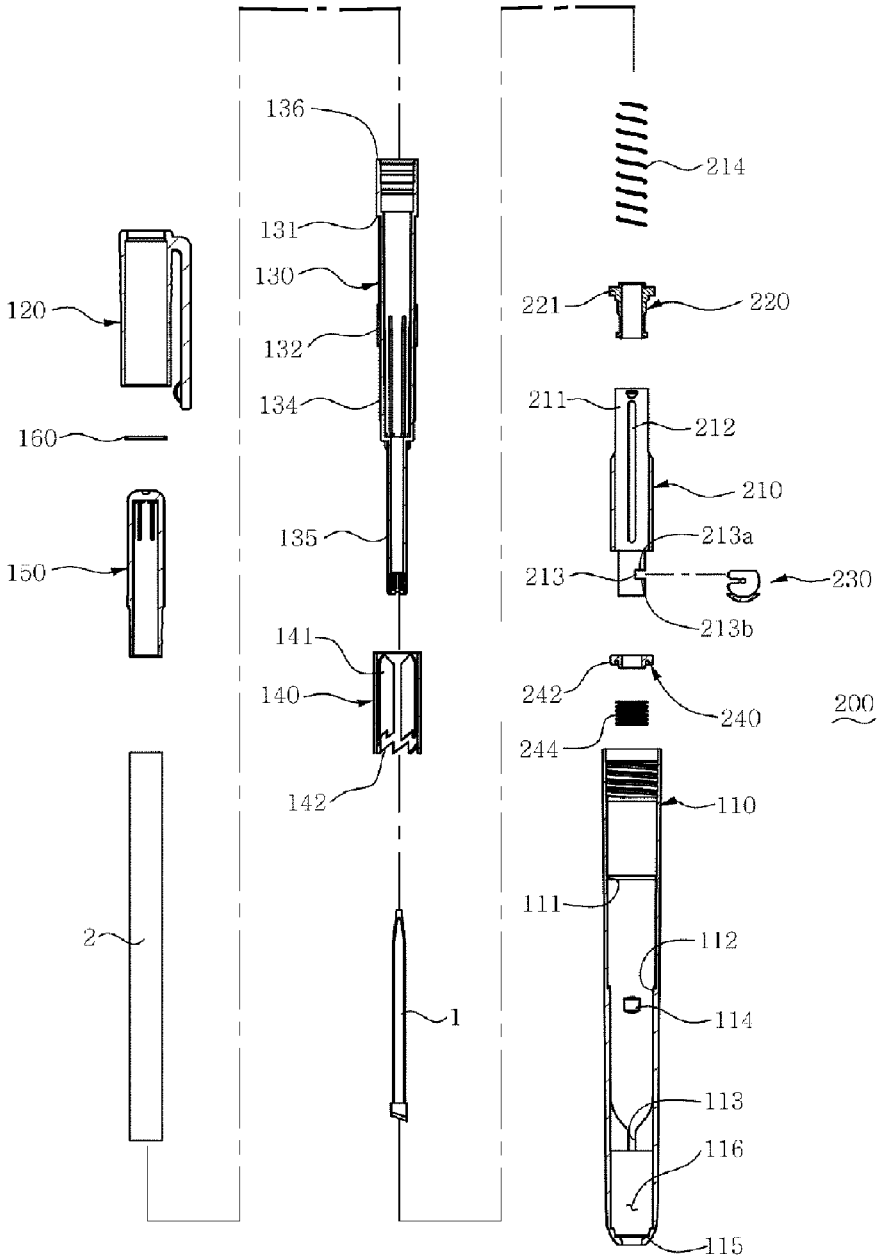
FIG. 2 is an exploded cross-sectional view of an example of the present invention.
Figure 3:
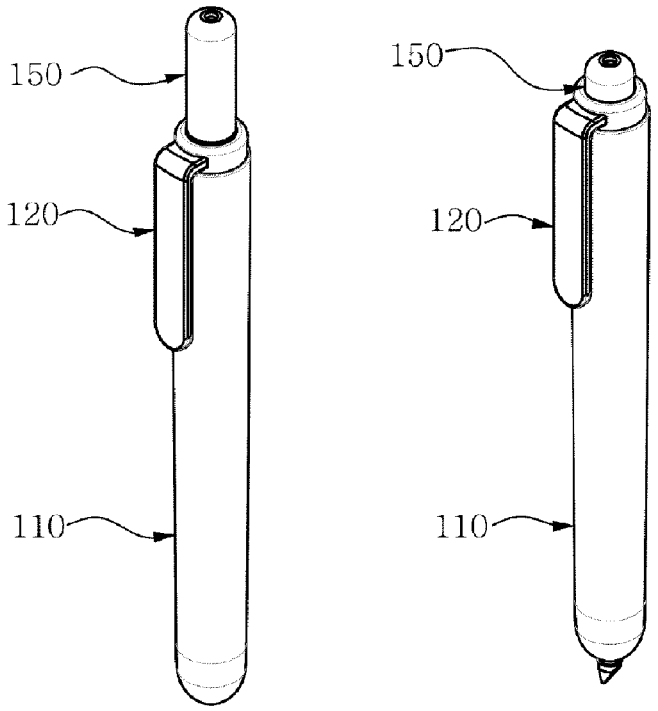
FIG. 3 is a schematic view of an example of the present invention.
Figure 4:
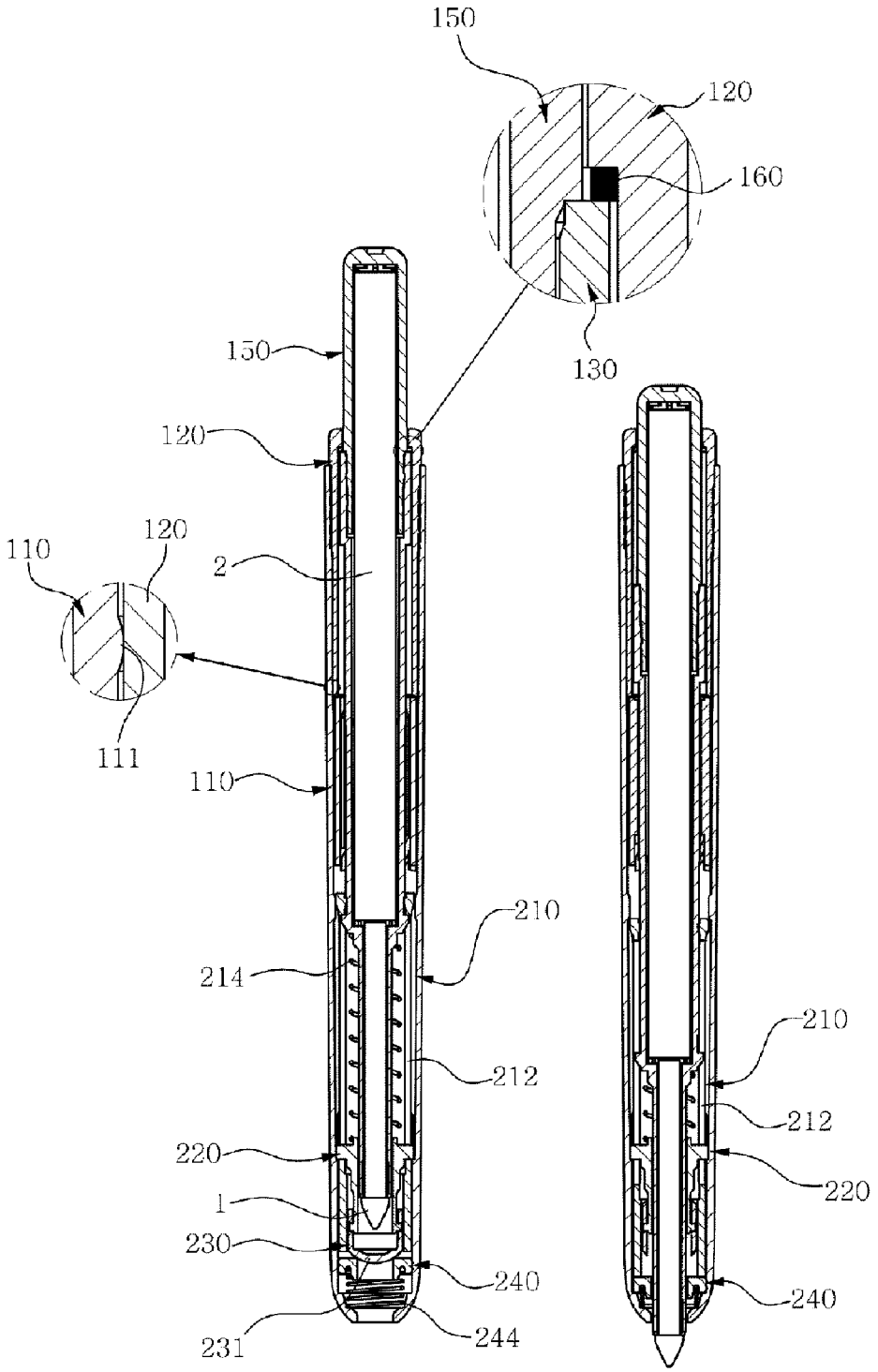
FIG. 4 is a sectional view of the operating state in the example of the present invention.
Figure 5:
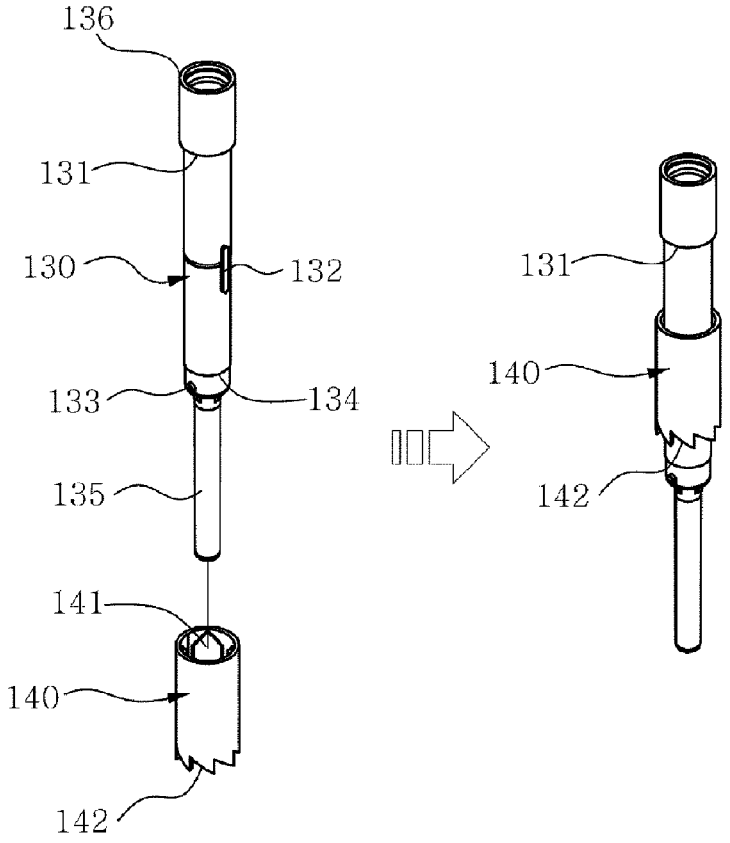
FIG. 5 is a perspective view showing the state of the tapping operation with an assembled ink cartridge in the example of the present invention.
Figure 6:
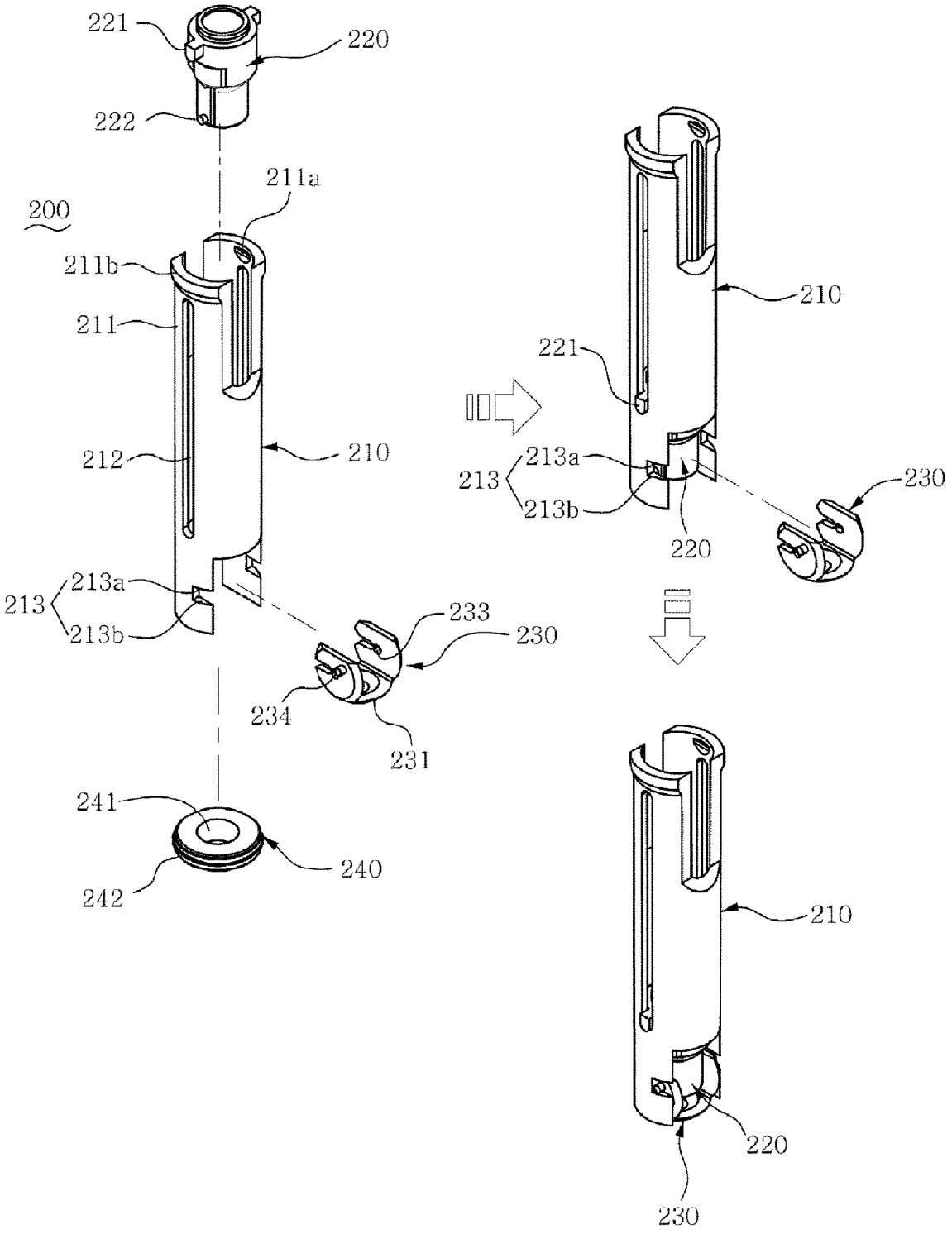
FIG. 6 shows the tightening sequence of the anti-drying device in the example of the present invention.
Figure 7:
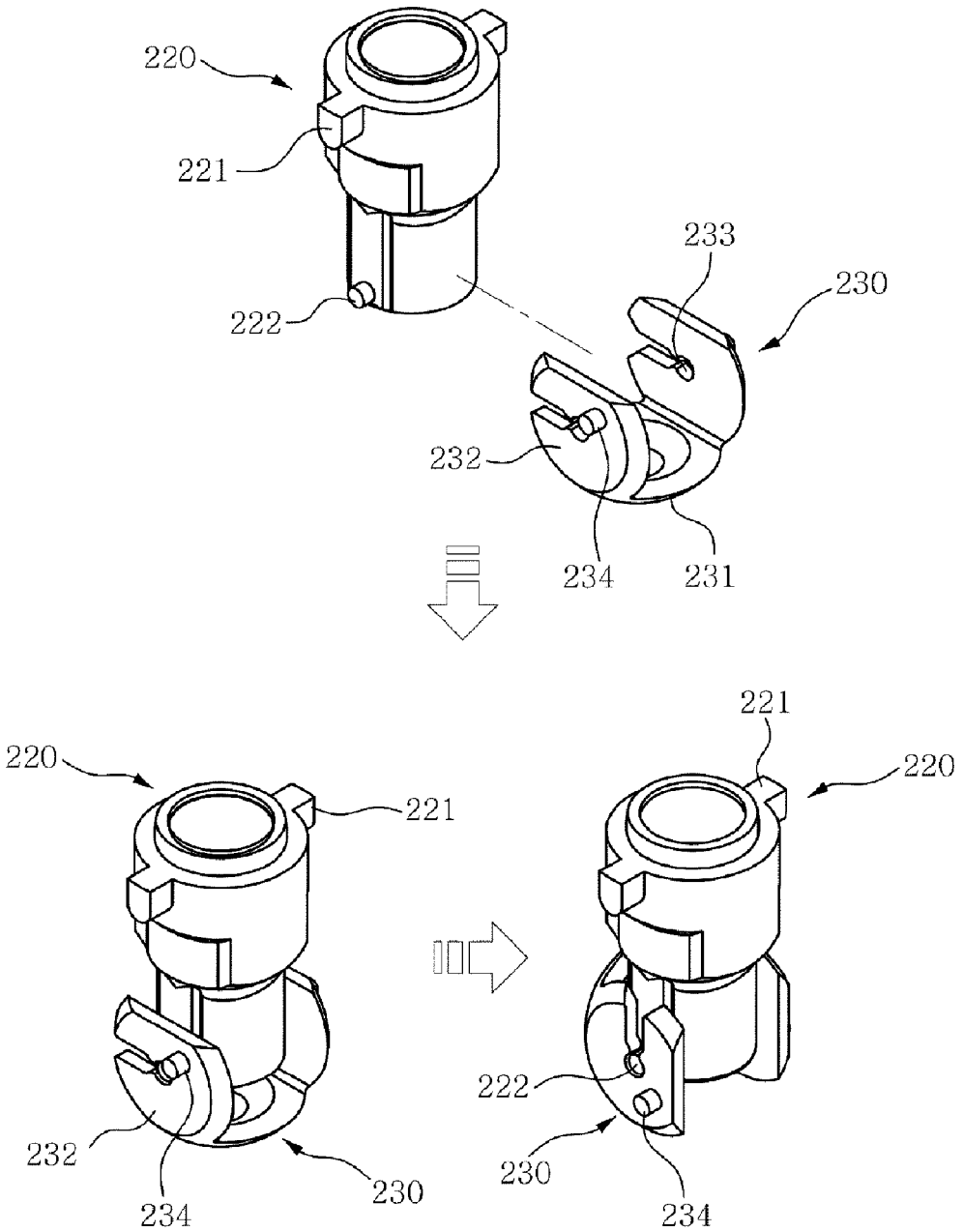
FIG. 7 is a perspective view showing the combined state of the lifting cap and the rotatable sealing cap in the example of the present invention.
Figure 8:
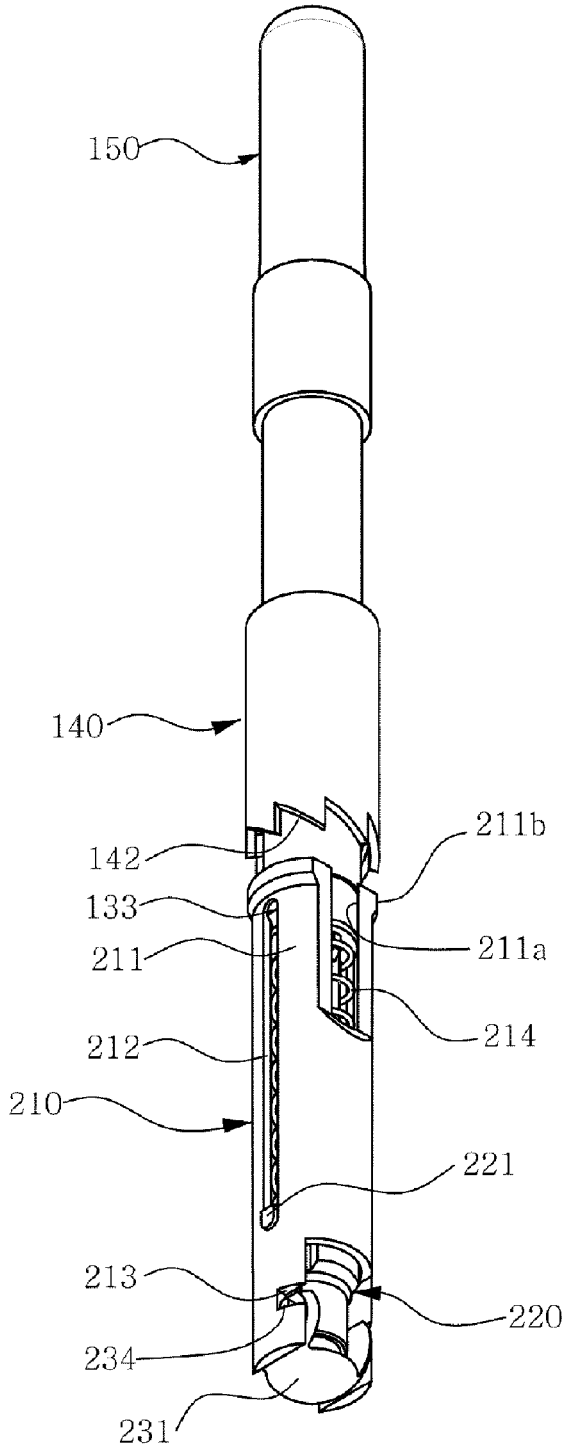
FIG. 8 is a perspective view showing the main components of the anti-drying device in the example of the present invention.
Figure 9:
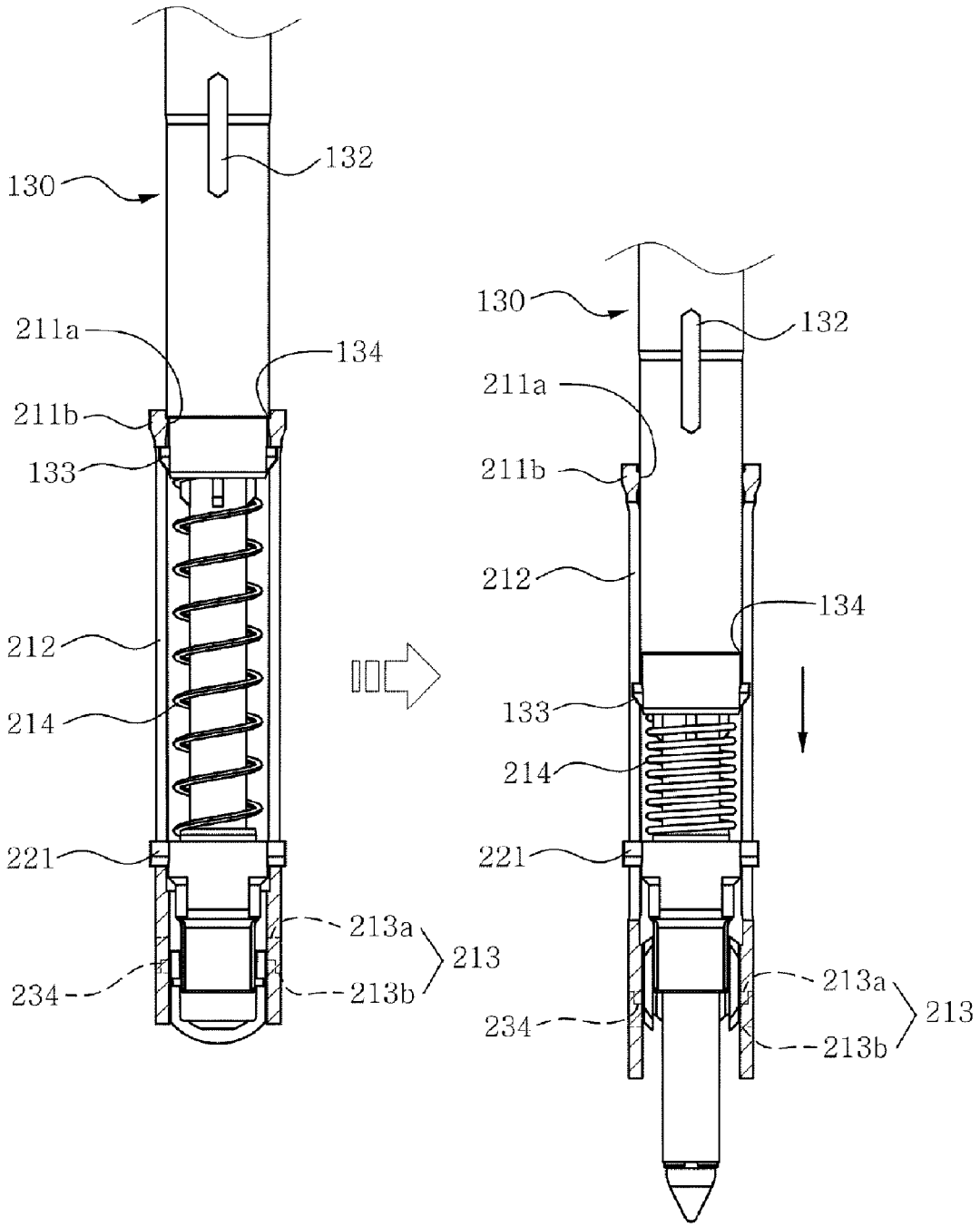
FIG. 9 is a cross-sectional view showing the descending state of the ink cartridge in the switch sleeve in the example of the present invention.
Figure 10:
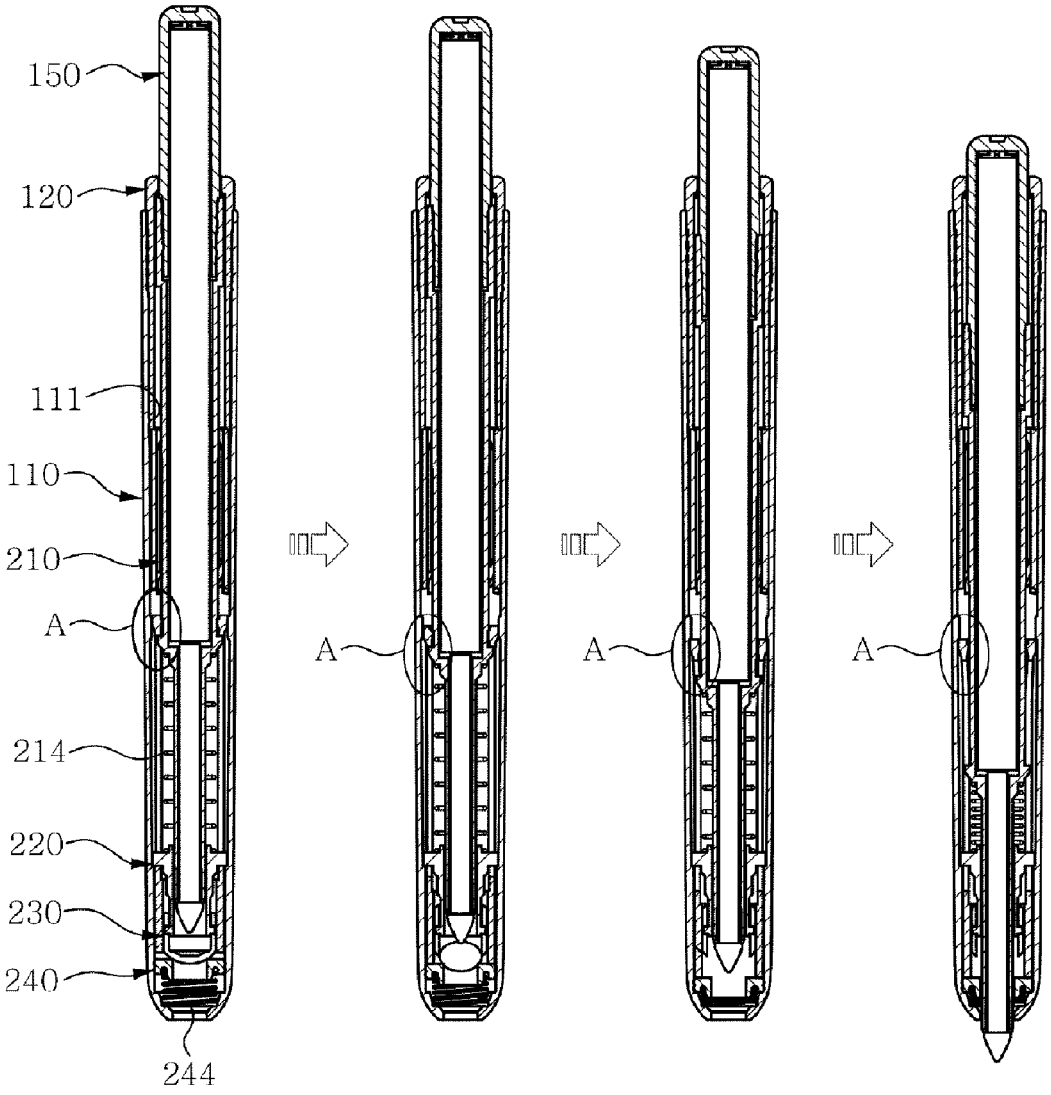
FIG. 10 is a sectional view showing the operation sequence in the example of the present invention.
Figure 11:
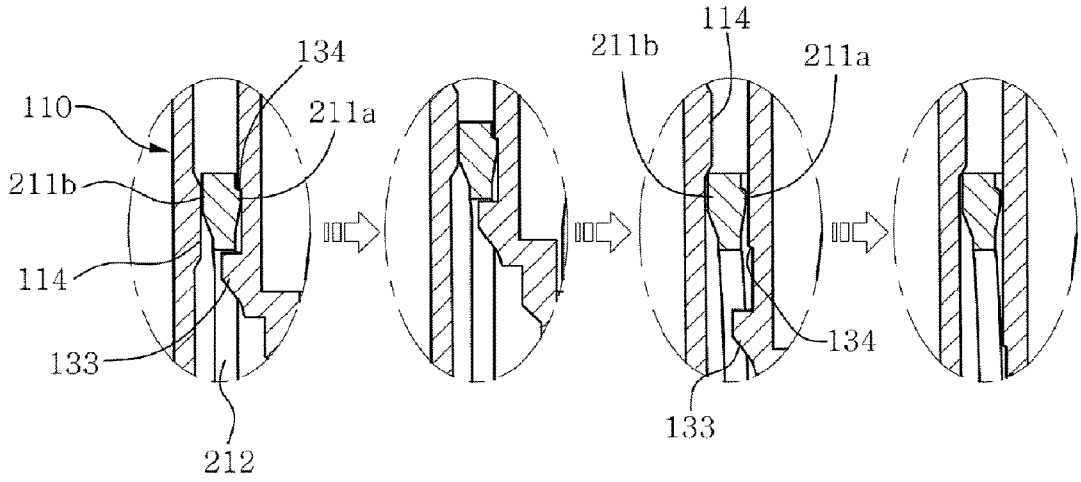
FIG. 11 is an enlarged cross-sectional view of the operating state of the ink cartridge and the switch sleeve of the part A in FIG. 10.
Figure 12:
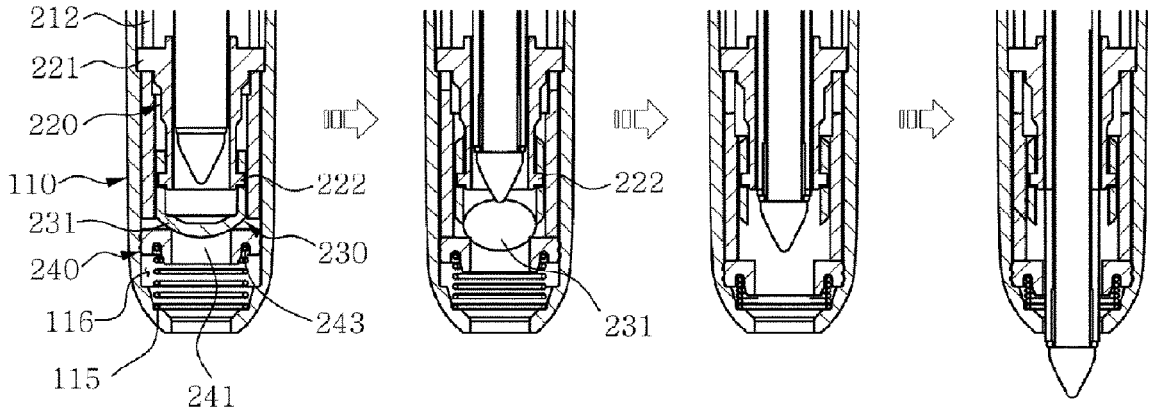
FIG. 12 is a sectional view showing the operation sequence of the rotatable sealing cap and the sealing pad in the example of the present invention.
Figure 13:
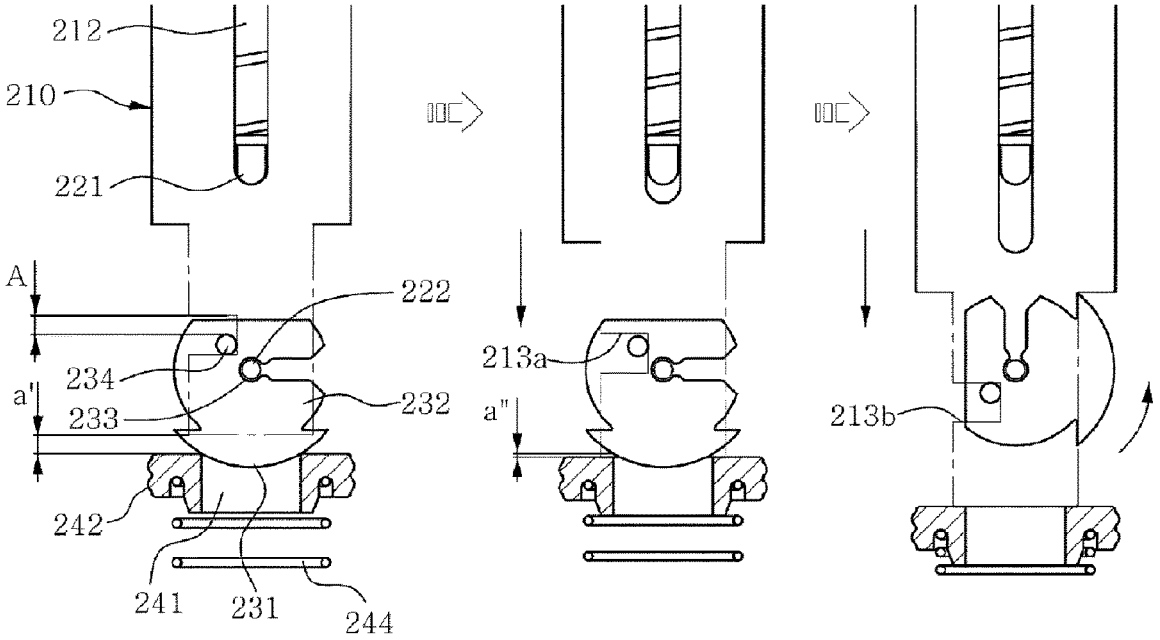
FIG. 13 is an enlarged view showing an operation of the rotatable sealing cap and the sealing pad in the example of the present invention.
Figure 14:
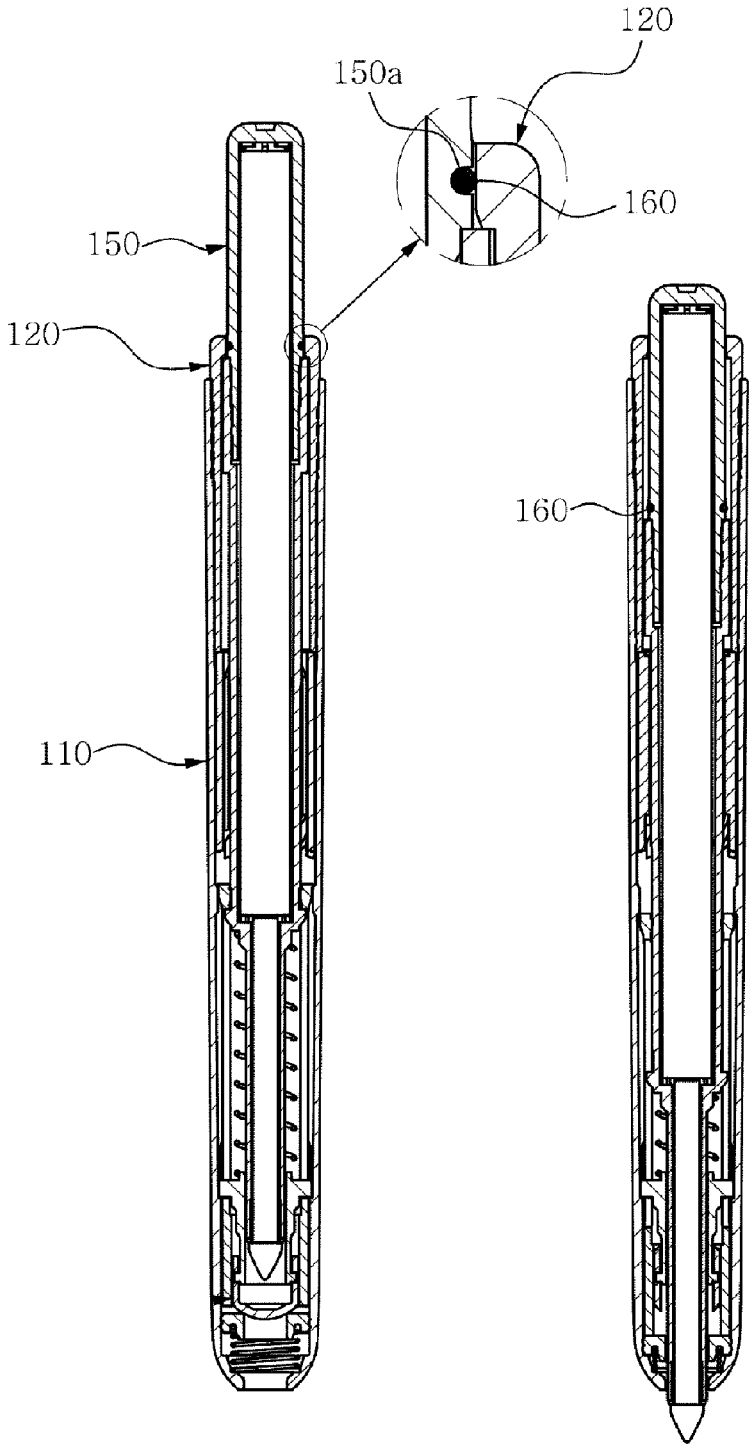
FIG. 14 is a cross-sectional view of another example where a sealing rubber ring is arranged onto a pressing rod.

As shown in FIG. 1 to FIG. 14, a writing tool with an anti-dry device according to the present invention is provided. The writing tool comprises: a penholder (110), a pen clip (120) which is provided at an upper portion of the penholder (110) in a threaded connection or a snap connection, a pressing rod (150) inserted into the penholder (110), a pen tip (1), an ink cartridge (130) and an anti-drying device (200) for sealing an opening end of the penholder (110) to prevent ink from drying out.

The ink cartridge (130) contains an ink filter (2) which supplies ink to the pen tip (1) provided in a core coupling tube (135).

A sealing ring (111) configured to create a seal at an internal connection area is seated inside the upper portion of the penholder (110), which is also in contact with an outer periphery of a lower portion of the pen clip (120). Rotating protrusions (112) matched with a tapping sleeve (140) are provided, which start from a middle portion of the penholder (110) and an upper portion of each rotating protrusion (112) has an inclined surface. The rotating protrusion (112) extends a certain length and ends at a lower portion where a mounting groove (113) is formed to allow supporting protrusions (221) provided on a lifting cap (220) to be inserted into. Limiting protrusions (114) configured to prevent a switch sleeve (210) from moving downwards first and then ascending is provided on an inner wall of the penholder (110) between two adjacent rotating protrusions (112). A spring mounting surface (115) where a supporting spring (244) is installed is provided inside a lower portion of the penholder (110), the spring mounting surface (115) is also configured to support a sealing pad (240).

An operating space (116) which allows the sealing pad (240) to be inserted into and supported by the supporting spring (244) to ascend and descend according to a set stroke is formed above the spring mounting surface (115).

The pen clip (120) coupled with the upper portion of the penholder (110) is inserted into the sealing ring (111) to prevent from forming a gap, thereby sealing an upper portion of the writing tool.

The pen clip (120) is provided with a sealing rubber ring (160) seated inside, which seals the interface between the pressing rod (150) lifting and lowering through an opening hole formed inside the pen clip (120) and an upper shielding surface (136) of the ink cartridge (130) so that air from outside could be blocked from entering into the penholder (110) from gaps thereamong.

The ink cartridge (130) equipped with the pen tip (1), the tapping sleeve (140) on top and the anti-drying device (200) on bottom is inserted into the penholder (110).

A limiting step surface (131) connecting to the tapping sleeve (140) is formed at an upper portion of the ink cartridge (130). Guiding protrusions (132) allowing the tapping sleeve (140) to slide thereon are formed on both sides of an outer middle part of the ink cartridge (130). Fastening lifting protrusions (133) which are configured to be inserted into through lifting grooves (212) formed on both sides of the switch sleeve (210) are provided on the ink cartridge (130) below the guiding protrusions (132). An anti-off clamping surface (134) is formed above the fastening lifting protrusions (133), which is matched with an anti-pressure protrusion (211*a*) of the switch sleeve (210). As two elastic parts (211) on both sides of the switch sleeve (210) return to original positions expanding outward, the size of the area between the two elastic parts (211) is greater than that of the anti-off clamping surface (134) below. The core coupling tube (135) configured to allow the pen tip (1) to be inserted into is formed at a bottom end of the ink cartridge (130) and a top end of the ink cartridge forms the upper shielding surface (136) that closely adheres to the sealing rubber ring (160).

The ink cartridge (130) and the pressing rod (150) are fixedly connected together by threads and the like.

Lifting tapping teeth (141) spaced equidistant from each other are provided inside the tapping sleeve (140). The diameter of annular teeth (142) formed at a lower end of the tapping sleeve (140) is larger than that of a circle surrounded by the tapping sleeve (140).

The anti-drying device (200) comprises the switch sleeve (210) where the lower portion of the ink cartridge (130) is inserted into, a lifting cap (220) capable of moving up and down in the switch sleeve (210), a tapping spring (214) on an upper portion of the lifting cap (220) for elastically supporting the ink cartridge (130), a rotatable sealing cap (230) coupled with a lower portion of the lifting cap (220), the sealing pad (240) allowing the pen tip (1) to extend out, which is inserted into the penholder (110) and closely attaches to the rotatable sealing cap (230) and the supporting spring (244) elastically supporting the sealing pad (240).

The lower portion of the ink cartridge (130) is inserted into the switch sleeve (210). Both sides of the upper portion of the switch sleeve (210) are cut apart according to a certain length to form the two elastic parts (211). The switch sleeve (210) is provided with two through lifting grooves (212) which respectively extends along the elastic parts (211) at a certain length. The lower portion of the switch sleeve (210) is formed a rotating groove (213) which is open to one side for mounting the rotatable sealing cap (230).

A rotating operation protrusion (234) is disposed in the rotating groove (213). An open operating surface (213*a*) where the rotating operation protrusion (234) could be pushed for rotation so as to open an access hole (241) on the sealing pad (240) is formed along the rotating groove (213), and a close operating surface (213*b*) where the rotating operation protrusion (234) could be pushed for rotation so as to close the access hole (241) on the sealing pad (240) is also formed along the rotating groove (213).

An anti-press protrusion (211*a*) is formed inside an upper end of each elastic part (211) and a locking protrusion (211*b*) mating with the limiting protrusion (114) inside the penholder (110) is formed outside the upper end of each elastic part (211).

The tapping spring (214) supporting the ink cartridge (130) recovers its elasticity and a tapping operation is completed.

The lifting cap (220) is downward inserted into the switch sleeve (210) and the two are in combination with each other. A supporting protrusion (221) is formed on each side of an upper portion of the lifting cap (220). The supporting protrusions (221) are respectively inserted into the lifting grooves (212) and a portion of each supporting protrusion (221) protruding from the lifting groove (212) is further inserted into the mounting groove (113). A rotating shaft (222) is formed on each side of a lower portion of the lifting cap (220) and the rotating shaft (222) is inserted into the rotatable sealing cap (230).

The rotatable sealing cap (230) is located at the lower portion of the switch sleeve (210) and the rotating protrusions (234) on both sides of the rotatable sealing cap (230) are inserted into the rotating grooves (213). The rotatable sealing cap (230) is connected to the lifting cap (220) by being inserted into downward.

The rotatable sealing cap (230) is tightly attached to an upper portion of the sealing pad (240). The rotatable sealing cap (230) includes a spherical closing surface (231) configured to seal a lower portion of the penholder (110) and a rotating support part (232) protruding upward provided on each side of the closing surface (231). The center of the rotating support part (232) is cut apart open to one side to form a shaft hole (233) into which the rotating shaft (222) is inserted. The open operating surface (213*a*) is formed along an upper portion of the rotating groove (213) and the close operating surface (213*b*) is formed along a lower portion of the rotating groove (213), and the rotating operation protrusion (234) is also formed on the rotating support part (232).

The rotating operation protrusion (234) is eccentrically located above the shaft hole (233) so that the switch sleeve (210) can move up and down relative to the center of the shaft hole (233) to drive the rotatable sealing cap (230) to complete the rotation operation.

When the rotatable sealing cap (230) is inserted into from the side of the switch sleeve (210), the rotating shaft (222) of the lifting cap (220) is inserted into the shaft hole (233).

The sealing pad (240) is inserted into the penholder (110) from the open upper end thereon and the center of the sealing pad (240) is opened the through access hole (241) allowing the pen tip (1) to extend out or be retracted. A contact ring (242) in contact with the inner wall of the penholder (110) is provided at the outer side of the sealing pad (240). A spring insertion groove (243) is formed at a lower portion of the sealing pad (240) where the supporting spring (244) for elastically supporting the sealing pad (240) is disposed so as to prevent the supporting spring (244) from falling off. The supporting spring (244) also could enable the sealing pad (240) and the rotatable sealing cap (230) to be elastically and tightly attached to each other.

In the embodiment of the present invention, an annular rubber groove (150*a*) is formed at a lower portion of the pressing rod (150) and a tightening sealing rubber ring (160) is provided on the annular rubber groove (150*a*). The sealing rubber ring (160) and the inner wall of the pen clip (120) are in a sliding connection to block air circulation.

The sealing rubber ring (160) which is provided on the annular rubber groove (150*a*) of the pressing rod (150) is in a shape of O-ring.

The operation process of the present invention will be explained as follows.

The present invention includes the penholder (110), the pressing rod (150) at the upper portion of the penholder (110) and the anti-drying device (200) being inserted into the penholder (110) to prevent ink from drying out. The access hole (241) allowing the pen tip (1) to extend out or be retracted on the sealing pad (240) is opened or closed by the anti-drying device (200) driven by the operation on the pressing rod (150) at the upper portion of the penholder (110), so that the anti-drying device (200) could close the access hole (241) on the sealing pad (240) to prevent ink from drying out when the pen is not in use.

When the pressing rod (150) is pressed, the ink cartridge (130) driven by the pressing rod (150) descends together until the limiting step surface (131) abuts on the tapping sleeve (140) there below. The anti-off clamping surface (134) pushes the anti-pressure protrusion (211*a*) protruding from the inner wall of the upper end of the switch sleeve (210) so that the switch sleeve (210) descends. The descending switch sleeve (210) exerts pressure on the sealing pad (240) elastically supported by the supporting spring (244) from bottom. After being pressed to a certain extent, the rotatable sealing cap (230) and the sealing pad (240) are separated, the open operating surface (213*a*) on the rotating groove (213) will push the rotating protrusions (234) on the outside of the rotating support part (232) so as to enable the rotatable sealing cap (230) to rotate to open the access hole (24) on the sealing pad (240), and the pen tip (1) on the core coupling tube (135) of the ink cartridge (130) could extend out toward the bottom of the penholder (110).

On one hand, when the annular teeth (142) of the tapping sleeves (140) reaches the rotating protrusions (112) below, the tapping sleeve (140) pushed by the limiting step surface (131) rotates a certain angle and descend to enable the rotating protrusions (112) to contact with the edge of the annular teeth (142), then the tapping sleeve (140) is placed in a position where the pen tip (1) on the ink cartridge (130) extends out toward the bottom of the penholder (110).

The anti-off clamping surface (134) formed on the lower portion of the ink cartridge (130) presses down the anti-pressure protrusion (211*a*) formed on the inside of the upper portion of the switch sleeve (210) so as to enable the switch sleeve (210) to descend, the sealing pad (240) is elastically supported by the supporting spring (244) from the bottom, the pressed sealing pad (240) keeps descending by a certain distance to further compress the supporting spring (244) so that a gap forms between the sealing pad (240) and the rotatable sealing cap (230).

When the rotatable sealing cap (230) and the he sealing pad (240) are apart, the ink cartridge (130) keeps moving downwards and the open operating surface (213*a*) on the upper portion of the rotating groove (213) will push the rotating operation protrusion (234), so that the rotatable sealing cap (230) will rotates along the rotating shaft (222) of the lifting cap (220) to one side so as to open the access hole (241) on the sealing pad (240) and allow the pen tip (1) coupled with the ink cartridge (130) to extend out.

At this time, the difference between the moving distance of the interval A between the open operating surface (213*a*) and the upper surface of the rotating operation protrusion (234) in the rotating groove (213) and the descending distance of the switch sleeve (210) to the sealing pad (240) a' is equal to the interval height a" between the sealing pad (240) and the rotatable sealing cap (230) apart. The rotatable sealing cap (230) opens the access hole (241) on the sealing pad (240) by its own rotating without friction there between.

On the other hand, the switch sleeve (210) is further pressed by the ink cartridge (130) to move downward, so as to further push the sealing pad (240) to descend; when the sealing pad (240) moves to the bottom, the anti-press protrusions (211*a*) and the locking protrusions (211*b*) are located beneath the limiting protrusion (114) inside the penholder (110).

The combined switch sleeve (210) and the sealing pad (240) moves down to the bottom, the anti-off clamping surface (134) is apart from the anti-press protrusions (211*a*) and the elastic parts (211) move to a space below the limiting protrusion (114) to be squeezed and stretched.

When the elastic parts (211) are stretched out, the anti-press protrusions (211*a*) are located above the anti-off clamping surface (134) and the locking protrusions (211*b*) protruding from the elastic parts (211) abuts on the bottom of the limiting protrusions (114) inside the penholder (110) so that the switch sleeve (210) is pressed on the sealing pad (240) and maintains a separation state between the rotatable sealing cap (230) and the sealing pad (240).

When the pressing rod (150) is pressed again, the limiting step surface (131) pushes the tapping sleeve (140) to move downward, and the descending tapping sleeve (140) will unlock the up-down positioning by the lifting tapping teeth (141) to drive the pen tip (1) to retract.

At this time, the tapping spring (214) in the switch sleeve (210) pushes the ink cartridge (130) to move upward, and the elastic parts (211) stretched by the anti-off clamping surface (134) moves to its original position, and locking protrusions (211*b*) and the limiting protrusions (114) inside the penholder (110) are unlocked, the switch sleeve (210) moves upward.

During the upward movement of the switch sleeve (210), the elastic force of the tapping spring (214) inside the switch sleeve (210) will push the ink cartridge (130) upward and the fastening lifting protrusions (133) on the lifting ink cartridge (130) will move upward along the lifting grooves (212) and move to the upper end of the switch sleeve (210).

When the switch sleeve (210) moves upward, the close operating surface (213*b*) of the rotating groove (213) pulls the rotating operation protrusion (234), and the rotating closing cap (230) rotates around the rotating shaft (222), so that the closing surface (231) could rotate and move from one side of the switch sleeve (210).

Under the elastic force of the support spring (244), the sealing pad (240) moves up a certain distance in the operating space (116), and the closing surface (231) of the rotating closing cap (230) is tightly attached to the access hole (241) on the sealing pad (240), the support spring (244) exerts pressure on the sealing pad (240) so as to close the access hole (241) on the sealing pad (240).

In one aspect, the upper portion of the pen holder (110) contacting with the lower portion of the outside of the pen clip (120) are sealed by the sealing ring (111), and the through upper portion of the pen clip (120) is sealed by a sealing rubber ring (110) so as to prevent air flowing into.

A hole formed on the sealing rubber ring (160) has a larger outer diameter than that of the pressing rod (150), so the sealing rubber ring (160) will not rub against the pressing rod (150) to ensure that the tapping operation is gentle and smooth.

On the one hand, like other examples of the present invention, the lower portion of the pressing rod (150) is formed with a sealing rubber ring groove (150*a*) for installing the sealing rubber ring (160), and the sealing rubber ring groove (150*a*) is provided with a sealing rubber ring (160). When the sealing rubber ring (160) is in contact with the inner wall of the pen clip and the pen tip (1) is extends out, there is a gap between the pen holder (120) and the downward pressing rod (150); and when the pen tip (1) in a retracted state, the gap between the pressing rod (150) moved upward and the inner side wall of the pen clip (120) are sealed through an O-ring sealing rubber ring (160).

The invention claimed is:

1. A writing tool with an anti-dry device comprising: a penholder (110), a pen tip (1) provided inside the penholder (110), an ink cartridge (130) and a pressing rod (150), wherein the pen tip (1) is connected to a lower portion of the ink cartridge (130), the pressing rod (150) is located on an upper portion of the ink cartridge (130) and configured to drive the ink cartridge (130) moving through the penholder (110), characterized in that:

an inner wall of a lower portion of the penholder (110) is provided with limiting protrusions (114), a mounting groove (113) and a spring mounting surface (115), wherein the limiting protrusions (114) is located above the spring mounting surface (115) and the mounting groove (113) is located between the limiting protrusions (114) and the spring mounting surface (115);

fastening lifting protrusions (133) and an anti-off clamping surface (134) are provided on an outer wall of the ink cartridge (130) and the anti-off clamping surface (134) is located above the fastening lifting protrusions (133);

and the writing tool is provided with an anti-drying device (200) including a switch sleeve (210), a lifting cap (220), a tapping spring (214), a rotatable sealing cap (230), a sealing pad (240) and a supporting spring (244);

wherein the switch sleeve (210) is inserted into the penholder (110), an upper portion of the switch sleeve (210) is respectively provided with an elastic part on both sides, and the switch sleeve (210) is provided with two lifting grooves which respectively extends along the elastic parts (211); an anti-press protrusion (211*a*) fitting with the anti-off clamping surface (134) is provided inside an upper end of each elastic part (211) and a locking protrusion (211*b*) mating with the limiting protrusion (114) is provided outside the upper end of each elastic part (211), and a lower portion of the switch sleeve (210) is formed a rotating groove (213) on both sides;

the lifting cap (220) is inserted into the switch sleeve (210), wherein an upper portion of the lifting cap (220) is provided with a supporting protrusion (221) on both sides and a lower portion of the lifting cap (220) is provided with a rotating shaft (222) on both sides, the fastening lifting protrusions (133) and the supporting protrusions (221) are located up and down and respectively inserted into the lifting grooves on corresponding sides and the supporting protrusions (221) are inserted into the mounting groove (113);

the tapping spring (214) is inserted into switch sleeve (210) and located between the lifting cap (220) and the ink cartridge (130);

the rotatable sealing cap (230) includes a closing surface (231) and a rotating support part (232) provided on each side of the closing surface (231), the rotating support part (232) is provided with a shaft hole (233) and a rotating operation protrusion (234) which is eccentrically located at one side of the shaft hole (233), and the rotating shaft (222) is inserted into the corresponding shaft hole (233) and the rotating operation protrusion (234) is inserted into the rotating groove (213);

the sealing pad (240) is provided with an access hole (241) allowing the pen tip (1) to extend out or be retracted, and is located below the switch sleeve (210), and the supporting spring (244) is arranged between the sealing pad (240) and the spring mounting surface (115), and the access hole (241) is opened and closed by the rotation of the rotatable sealing cap (230).

2. The writing tool with an anti-dry device according to claim 1, characterized in that comprising a pen clip (120); the pen clip (120) is inserted into the upper portion of the penholder (110) and the pressing rod (150) is inserted into the pen clip (120) and connected to the ink cartridge (130), the inner wall of the penholder (110) is provided with a sealing ring (111) attaching to an outer wall of the pen clip (120).

3. The writing tool with an anti-dry device according to claim 2, characterized in that an outer wall of the pressing rod (150) is provided with a sealing rubber ring groove (150*a*), and a sealing rubber ring (160) is arranged in the sealing rubber ring groove (150*a*) and located between the pen clip (120) and the pressing rod (150).

4. The writing tool with an anti-dry device according to claim 1, characterized in that a spring insertion groove (243) is formed at a lower portion of the sealing pad (240) where an upper end of the supporting spring (244) is inserted into.

5. The writing tool with an anti-dry device according to claim 1, characterized in that a plurality of rotating protrusions (112) are provided on the inner wall of the penholder (110) distributed around the center line of the penholder (110); the outer wall of the ink cartridge (130) is provided with guiding protrusions (132) and a limiting step surface (131) and the limiting step surface (131) is located above the guiding protrusions (132);

the writing tool with an anti-dry device further includes a tapping sleeve (140), lifting tapping teeth (141) spaced equidistant from each other around an axis of the tapping sleeve (140) are provided inside the tapping sleeve (140), annular teeth (142) are provided at a lower portion of the tapping sleeve (140); wherein the lifting tapping teeth (141) are fitting with the guiding protrusions (132) and the annular teeth (142) are clamped on the rotating protrusions (112).

6. The writing tool with an anti-dry device according to claim 1, characterized in that: when the pen tip (1) is retracted into the penholder (110), the closing surface of the rotatable sealing cap (230) abuts against the sealing pad (240) and seals the access hole (241); when the pen tip (1) extends out of the pen holder (110), the closing surface of the rotatable sealing cap (230) rotates to one side of the sealing pad (240) to open the access hole (241).

7. The writing tool with an anti-dry device according to claim 2, characterized in that: when the pen tip (1) is retracted into the penholder (110), the closing surface of the rotatable sealing cap (230) abuts against the sealing pad (240) and seals the access hole (241); when the pen tip (1) extends out of the pen holder (110), the closing surface of the rotatable sealing cap (230) rotates to one side of the sealing pad (240) to open the access hole (241).

8. The writing tool with an anti-dry device according to claim 3, characterized in that: when the pen tip (1) is retracted into the penholder (110), the closing surface of the rotatable sealing cap (230) abuts against the sealing pad (240) and seals the access hole (241); when the pen tip (1) extends out of the pen holder (110), the closing surface of the rotatable sealing cap (230) rotates to one side of the sealing pad (240) to open the access hole (241).

9. The writing tool with an anti-dry device according to claim 4, characterized in that: when the pen tip (1) is retracted into the penholder (110), the closing surface of the rotatable sealing cap (230) abuts against the sealing pad (240) and seals the access hole (241); when the pen tip (1) extends out of the pen holder (110), the closing surface of the rotatable sealing cap (230) rotates to one side of the sealing pad (240) to open the access hole (241).

10. The writing tool with an anti-dry device according to claim 5, characterized in that: when the pen tip (1) is retracted into the penholder (110), the closing surface of the rotatable sealing cap (230) abuts against the sealing pad (240) and seals the access hole (241); when the pen tip (1) extends out of the pen holder (110), the closing surface of the rotatable sealing cap (230) rotates to one side of the sealing pad (240) to open the access hole (241).

* * * * *